US005126559A

United States Patent [19]

Reynolds

[11] Patent Number: 5,126,559

[45] Date of Patent: Jun. 30, 1992

[54] FIBER OPTIC PRESSURE SENSOR FOR SAFING AND ARMING A FUZE

[75] Inventor: John E. Reynolds, Plymouth, Minn.

[73] Assignee: Alliant Techsystems Inc., Edina, Minn.

[21] Appl. No.: 683,142

[22] Filed: Apr. 10, 1991

[51] Int. Cl.[5] ..... H01J 5/16

[52] U.S. Cl. ..... 250/227.21; 102/213

[58] Field of Search ..... 250/551, 231.1, 227.21, 250/227.24; 102/213

[56] References Cited

U.S. PATENT DOCUMENTS

| | | | |
|---|---|---|---|
| 3,901,597 | 8/1975 | White | 356/4 |
| 3,903,412 | 9/1975 | Simpson et al. | 102/213 |
| 3,935,818 | 2/1976 | Johnson et al. | 102/70.2 P |
| 3,937,575 | 2/1976 | Bateman | 356/5 |
| 4,309,946 | 1/1982 | Block | 102/213 |
| 4,505,582 | 3/1985 | Zuleeg et al. | 356/5 |
| 4,576,346 | 3/1986 | Gauggel et al. | 244/3.16 |
| 4,611,912 | 9/1986 | Falk et al. | 356/5 |
| 4,733,609 | 3/1988 | Goodwin et al. | 102/213 |
| 4,776,274 | 10/1988 | Kriz et al. | 102/213 |
| 4,824,251 | 4/1989 | Slotwinski et al. | 356/349 |
| 4,859,054 | 8/1989 | Harrison | 356/5 |
| 4,987,832 | 1/1991 | Klink et al. | 102/213 |

*Primary Examiner*—David C. Nelms
*Assistant Examiner*—Khaled Shami
*Attorney, Agent, or Firm*—Jane H. Arrett; John R. Flanagan

[57] ABSTRACT

An arrangement used in safing and arming a munition device. The pressure sensor responds to pressure generated by igniting propellant of the munition and displaces from a first to second position. The power supply responds to setback of the munition to generate an electrical voltage. The light-emitting device responds to the electrical voltage. The photosensitive device connected to the power supply is powered by generation of the voltage and responds to receipt of light energy. An electro-explosive actuator connected to the photosensitive device is operable in response to electrical energy to actuate a rotor of the munition fuze from an unarmed condition to an armed condition. A fiber optic routing element defines a light transmission path from the light-emitting device to the photosensitive device via the pressure sensor. The pressure sensor responds to contact by expanding high pressure gases generated from igniting of the propellant to move from the first to second position and transmit sufficient light energy from the light-emitting device to the photosensitive device via a reflective surface of the pressure sensor at the second position to cause the photosensitive device to conduct electrical energy to the electro-explosive actuator. The actuator thus does not actuate the rotor fuze from the unarmed condition to armed condition without both setback and propellant ignition occurring first.

18 Claims, 3 Drawing Sheets

FIBER OPTIC PRESSURE SENSOR FOR SAFING AND ARMING A FUZE

BACKGROUND OF THE INVENTION

2. Field of the Invention

The present invention generally relates to munitions employing materials which need to be ignited or detonated to attain proper function and, more particularly, is concerned with a fiber optic pressure sensor for safing and arming a fuze used to ignite or detonate the munition.

2. Description of the Prior Art

Munitions which contain materials that need to be ignited or detonated to attain proper function typically have a safing and arming arrangement operable to ensure that arming of the munition fuze does not occur inadvertently, but rather only at a desired moment. A fuze is considered "armed" generally when an explosive train is "in line", that is, when the detonator is in position to initiate the booster charge or main charge of the munition. Examples of these types of munitions may include high explosive, shaped charge, illumination, and smoke projectiles.

Preferably, the intent of using a safing and arming arrangement is to provide a munition which only functions under a narrowly defined set of conditions, for example, the conditions which exist when the munition is propelled from its launcher. These environmental conditions can be used to arm the fuze.

A conventional type of a launcher is a projectile-firing device, composed essentially of a projectile-guide tube incorporating a reaction chamber in which chemical energy of a propellant is rapidly converted into heat. The hot gases produced expand to expel the projectile at a high velocity The reaction of the propellant produces the conditions which can be used to arm the fuze. The environmental conditions which the projectile is subjected to include setback (the high acceleration of launch), pressure, heat, noise, light and spin (if the launcher is rifled).

A need still remains for a way to utilize the pressure produced by the igniting and burning propellant as a primary or secondary safing environment for a fuze.

SUMMARY OF THE INVENTION

The present invention provides a fiber optic pressure sensor arrangement designed to satisfy the aforementioned needs. The arrangement of the present invention senses the pressure produced by igniting propellant in a cartridge case of the munition. A pressure sensor of the arrangement moves a reflective surface into position to reflect the light from a LED (light emitting diode) via a fiber optic cable. The reflected light illuminates a photo sensitive transistor via another fiber optic cable causing it to conduct electricity. When the photo transistor conducts it provides a signal used to arm the fuze.

Accordingly, the present invention is directed to an arrangement for use in safing and arming a fuze in a munition. The arrangement comprises: (a) first means responsive to the occurrence of a first environmental condition of the munition for producing displacement of the first means from a first position to a second position; (b) second means responsive to the occurrence of a second environmental condition of the munition for generating an electrical voltage and emitting light energy, the second environmental condition being different from the first environmental condition: (c) third means responsive to generation of the voltage and receipt of light energy for conducting electrical energy; (d) fourth means responsive to conducting of the electrical energy for actuating a rotor of the munition fuze from an unarmed condition to an armed condition; and (e) fifth means for defining a light transmission path from the second means to the third means via the first means.

More particularly, the first means of the arrangement being responsive to the first environmental condition is a pressure sensor responsive to pressure generated by the igniting of a propellant of the munition. In a preferred form, the pressure sensor has a housing, a piston reciprocal between the first and second displaced positions in the housing and having a light reflective surface, and a blocking element for maintaining the piston at the first position but being fracturable by imposition of a force of a predetermined magnitude thereon. The piston is responsive to contact by expanding high pressure gases generated from igniting of the propellant in the munition for producing a force of a magnitude greater than the predetermined magnitude of force to fracture of the blocking element and thereby permitting movement of the piston from the first position to the second position.

The second means of the arrangement being responsive to the second environmental condition includes a setback-activated power supply, such as a battery, responsive to a setback, or initial acceleration, of the projectile of the munition, such as caused by ignition of the propellant or by an inadvertent non-ignition related impact force against the munition, to produce an electrical voltage, and a light-emitting device, such as a LED, connected to the battery which is responsive to the electrical voltage to emit light energy.

The third means of the arrangement being responsive to generation of the voltage and receipt of light energy is a photosensitive device connected to the battery. The third means is switched "on" to a conducting mode when receiving light energy. In the absence of light energy, the third means is switched "off" to a non-conducting mode.

The fourth means of the arrangement being responsive to receipt of the electrical energy is an actuator, such as an electro-explosive actuator. When the electro-explosive actuator receives electrical energy it produces a mechanical force of a magnitude sufficient to actuate the rotor of the munition fuze from an unarmed condition to an armed condition.

The fifth means of the arrangement includes a light routing element for transmitting light energy along the light transmission path from the second means to the third means via the first means. The light routing element is a pair of first and second fiber optic cables. The first fiber optic cable defines a first branch of the light transmission path from the light-emitting device of the second means to the light reflective surface of the pressure sensor piston of the first means. The second cable defines a second branch of the light transmission path from the light reflective surface of the pressure sensor piston of the first means to the photosensitive device of the third means.

The light routing element is responsive to the displacement of the pressure sensor piston of the first means to the first position for transmitting insufficient light energy from the light-emitting device of the second means to the photosensitive device of the third means via the reflective surface of the piston at the first position to cause the third means to conduct electrical energy to the fourth means. On the other hand, the light routing element is responsive to the displacement of the pressure sensor piston of the first means to the second position for transmitting sufficient light energy from the light-emitting device of the second means to the photosensitive device of the third means via the reflective surface of the piston at the second position to cause the third means to conduct electrical energy to the fourth means. Thus, the fourth means is incapable of actuating the fuze rotor from the unarmed condition to armed condition without both the first and second environmental conditions of the munition occurring first, namely setback of the munition projectile and ignition of the propellant of the munition.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

In General

Figure 1:
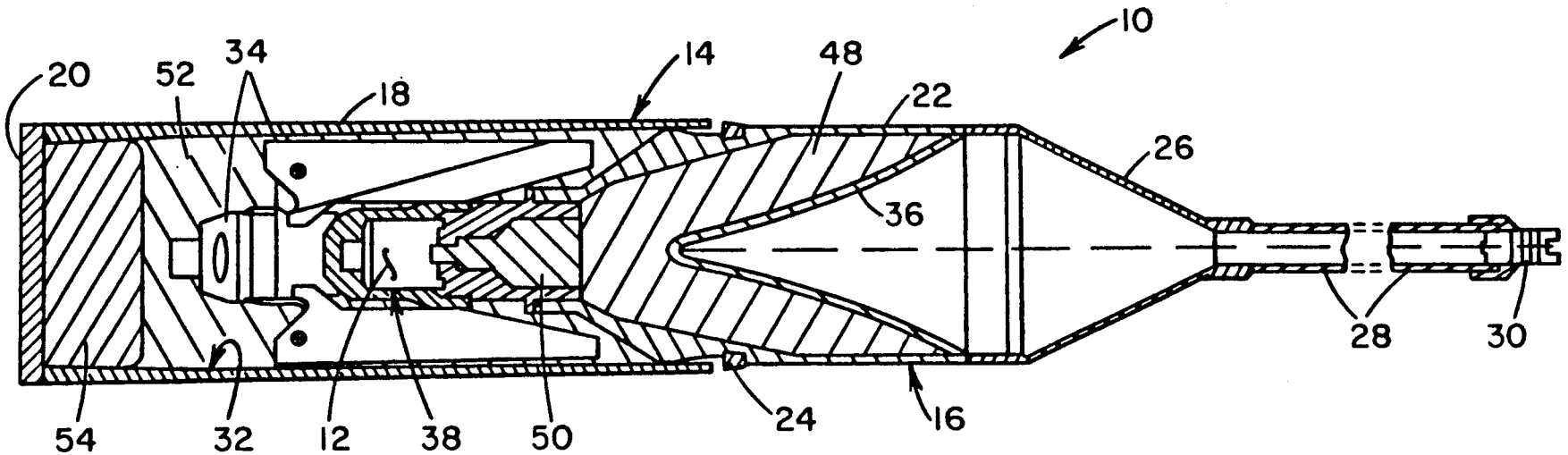
FIG. 1 is a longitudinal axial sectional view of a munition employing a fiber optic pressure sensor arrangement of the present invention.

Referring to the drawings, and particularly to FIG. 1, there is shown an example of a munition, generally designated 10, in which is employed a fiber optic pressure sensor arrangement 12 in accordance with the present invention. The munition 10 shown in FIG. 1 is but one example of a munition in which the fiber optic pressure sensor arrangement 12 of the present invention can be employed. The munition 10 illustrated in FIG. 1 forms no part of the present invention, and so will be described hereinafter only in the detail needed for one of ordinary skill in the art to understand the present invention.

The munition 10 is composed of a cartridge case 14 and a projectile 16. The cartridge case 14 is composed of a cylindrical sidewall 18 and aft base plate 20. The base plate 20 is attached, such as by crimping, to the aft end of the cylindrical sidewall 18 to close the rear end of the sidewall 18. The projectile 16 is mounted within and extends forwardly from a forward open end of the case sidewall 18.

The projectile 16 includes an elongated body 22 which is attached, such as by crimping, to the forward open end of the cartridge case sidewall 18 approximately midway along the length of the body 22 at a location immediately aft of an annular sealing ring 24 which is seated about the projectile body 22. A windscreen 26 is threaded to the forward end of the projectile body 22 and a standoff probe 28, having an impact sensor 30 on its leading end, is threaded to and extends forwardly from the windscreen 26.

The projectile body 22 extends rearwardly within a chamber 32 defined by the cartridge case 14 and has a fin holder 34 mounted about the exterior of the rear end of the body 22, a shaped charge liner 36 disposed within the forward portion of the body 22, and a fuze 38 disposed within a rearward portion of the body 22.

Figure 2:
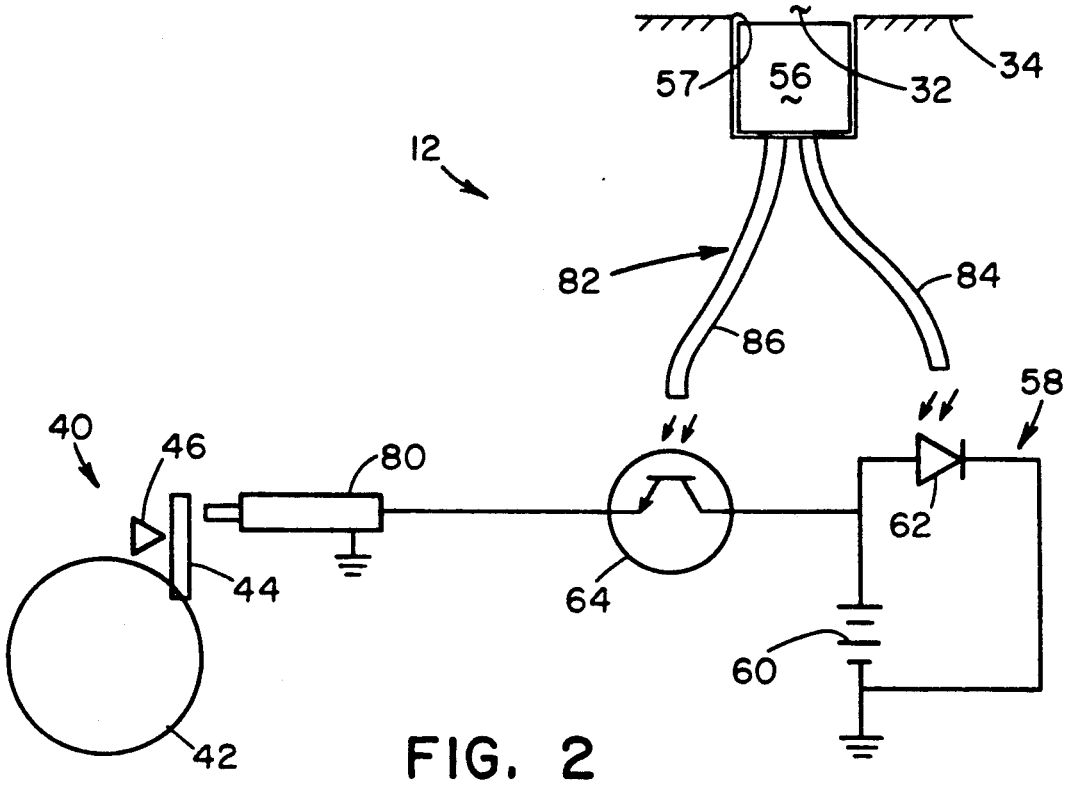
FIG. 2 is a schematic view of the fiber optic pressure sensor arrangement of the present invention illustrating conditions that exist prior to munition firing.
Figure 4:
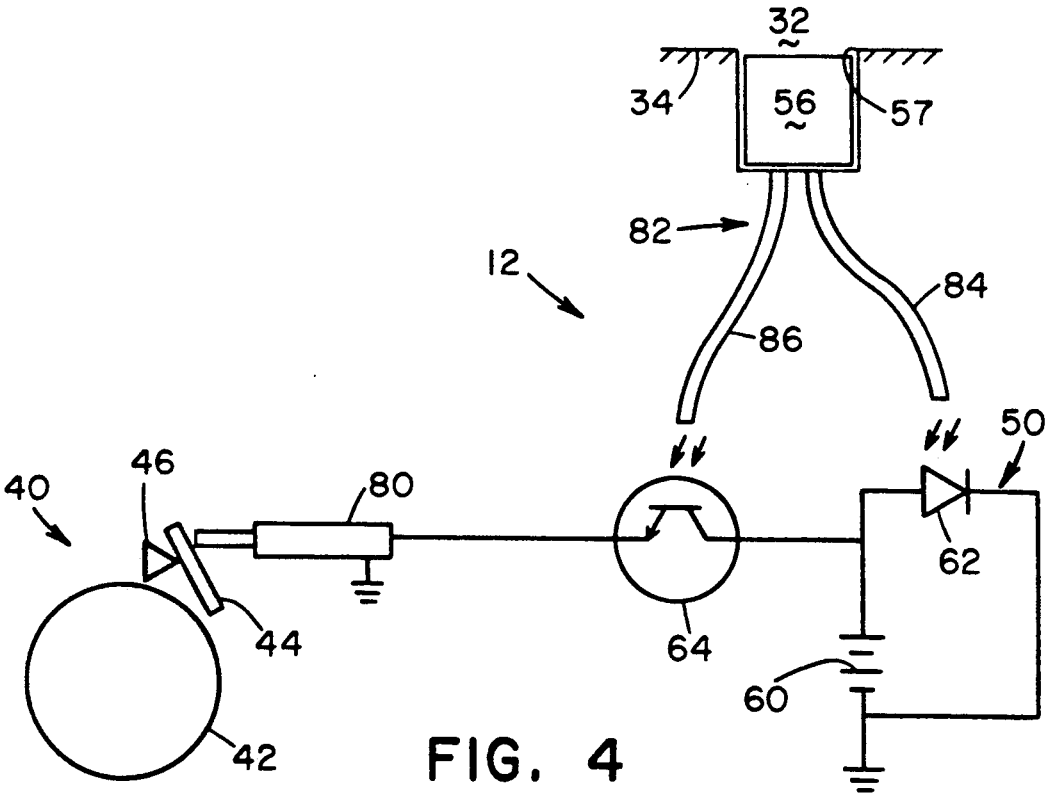
FIG. 4 is a schematic view of the fiber optic pressure sensor arrangement illustrating conditions that exist at the time of munition firing.

As shown schematically in FIGS. 2 and 4, a safing and arming device 40 in the fuze 38. The safing and arming device 40 includes a fuze rotor 42 and a lever 44. The lever 44 holds the rotor 42 which contains a detonator (not shown) in an unarmed or safe condition. Pivoting of the lever 44 about a fulcrum 46 away from the rotor 42 permits the rotor 42 to turn to an armed condition for detonating the fuze 38.

Also, a main explosive charge 48 is housed within the projectile body 22 about the exterior of and extending rearwardly of the shaped charge liner 36. A booster charge 50 is disposed within the projectile body 22 between the main explosive charge 48 and the fuze 38.

A propellant 52 is disposed in the chamber 32 of the cartridge case 14 rearwardly of and surrounding the fin holder 34 and the rear portion of the projectile 16. A primer cap assembly 54 is located in the chamber 32 on the interior side of the base plate 20 of the case 14. The primer cap assembly 54 is operable, when actuated in a conventional known manner, to ignite the propellant 52. The ignition and burning of the propellant 52 produces gases at high pressure within the chamber 32 which is sufficient to launch the projectile 16 from the case 14.

Fiber Optic Pressure Sensor of the Invention

Figure 5:
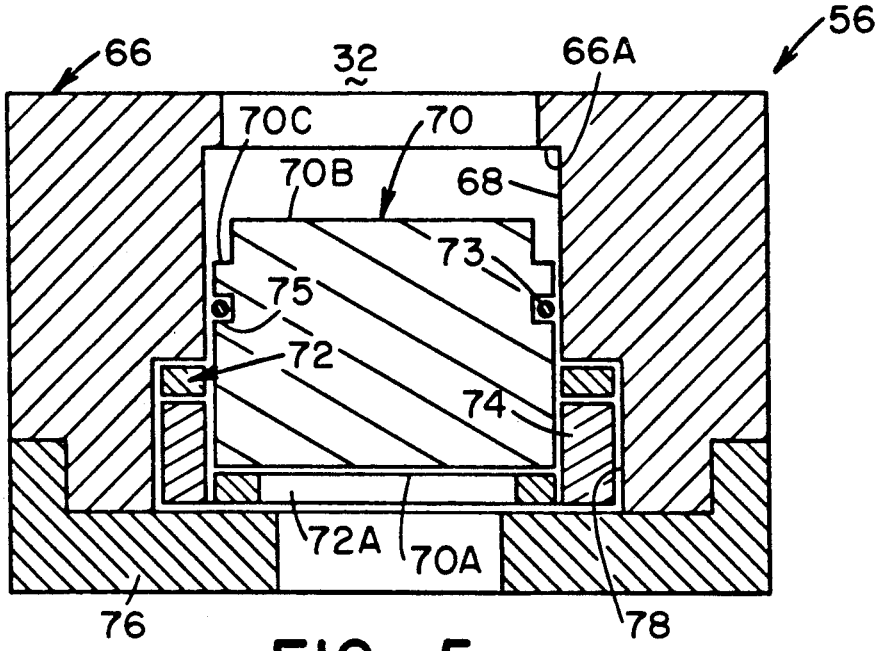
FIG. 5 is an enlarged schematic view of the pressure sensor of the arrangement of FIG. 4 illustrating the state of the sensor at the time of munition firing.

Referring to FIGS. 2-5, there is schematically illustrated the fiber optic pressure sensor arrangement 12 in accordance with the present invention which is used in conjunction with the safing and arming device 40 in the munition fuze 38. In its basic components, the fiber optic sensor arrangement 12 includes a pressure sensor 56 and a circuit 58 composed of a power supply 60, a light-emitting device 62 and a photosensitive device 64. The pressure sensor 56 of the arrangement 12 responds to the occurrence of a first environmental condition of the munition 10, such being a high pressure generated by igniting of the propellant 52 of the munition 10 employed in launching the projectile 16, and displaces from a first position (FIG. 3) to second position (FIG. 5).

Figure 3:
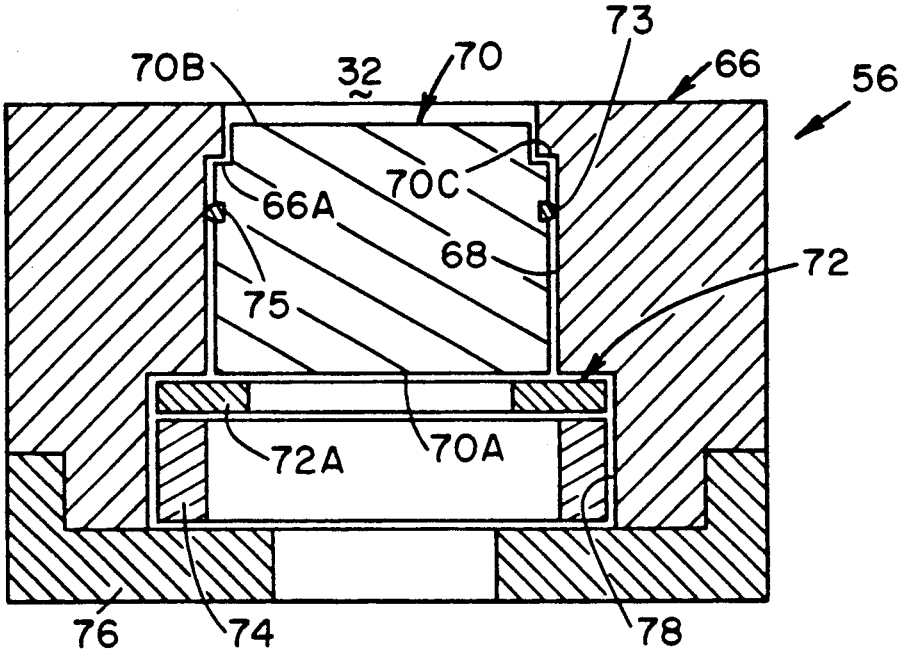
FIG. 3 is an enlarged schematic view of a pressure sensor of the arrangement of FIG. 2 illustrating the state of the sensor prior to munition firing.

Referring to FIGS. 2 and 4, the pressure sensor 56 communicates with the chamber 32 of the case 14 through an opening 57 in the fin holder 34. As seen in FIGS. 2-5, the pressure sensor 56 includes a housing 66 having a central bore 68, a cylindrical piston 70 reciprocal between the first and second displaced positions in the bore 68 of the housing 66, and a blocking element 72 in the form of an annular shear washer 72 for maintaining the piston 70 at the first position. The piston 70 has an integral gas seal or O-ring 73 seated in an annular groove 75 defined about the circumference of the piston 70. The piston 70 at its inner side has a light reflective surface 70A and at its outer side 70B is in contact with the atmospheric pressure within the chamber 32 of the cartridge case 14. The first position of the piston 70, as seen in FIG. 3, is defined between the shear washer 72 and an internal annular shoulder 66A on the housing 66 which overlaps with an external circumferential shoulder 70C on the piston 70. In the first position, the piston 70 sits on the inner annular edge portion 72A of the shear washer 72 which projects into the bore 68.

The pressure sensor 56 also includes a support washer 74 and an annular base 76. The housing 66 also has an annular recess 78 formed about the inner end of the bore 68. The annular base 76 is attached to the inner end of the housing 66 and confines the support washer 74 and the shear washer 72 supported by the support washer 74 in the recess 78. The support washer 74 has an interior diameter substantially the same as that of the housing bore 68 for accommodating reciprocable movement of the piston 70 to its second position seen in FIG. 5. The inner annular portion 72A of the shear washer 72 can be fractured or sheared from the remainder of the washer 72 by imposition of a force of a predetermined magnitude thereon. The piston 70 is responsive to contact by expanding high pressure gases generated from igniting of the propellant 52 in the chamber 32 to produce a force of a magnitude sufficiently greater than the shear force required to fracture the shear washer 72, as shown in FIG. 5, and move from the first position of FIG. 3 to the second position of FIG. 5. (Peak chamber pressure varies from one weapon system to another, but typically reaches 65–75 MPa, or 9425–10875 psi, in the type of munition illustrated in FIG. 1.)

The power supply 60 in the circuit 58 of the fiber optic pressure sensor arrangement 10, which can be a setback-activated battery, responds to the occurrence of a second environmental condition of the munition 10 to produce an electrical voltage for activating the light-emitting device 62. The second environmental condition, which differs from the first environmental condition, is the setback or reaction force produced by the projectile 16 of the munition 10 such as when the projectile 16 is launched from the case 14. Parenthetically, it should be noted that the setback force can also be produced by a non-launch event, such as an inadvertent dropping of the munition 10 on its base plate 20. However, since the first environmental condition, the ignition of the propellant and generation of the high pressure, would not occur as a result of an inadvertent dropping of the munition 10, then there would be no movement of the piston 70 to the second position solely on the occurrence of the non-launch setback force.

The electrical voltage produced by the battery 60 causes the light-emitting device 62, preferably a LED, to emit light energy. The photosensitive device 64, such as a photo transistor, is also connected to the power supply or battery 60 and is powered by the voltage generated by the battery 60. The photosensitive device 64 is switched "on" to a conducting mode when receiving light energy. In the absence of light energy, the device is switched "off" to a non-conducting mode. Thus, in response to receipt of light energy and to the electrical voltage imposed on it, the photosensitive device 64 will conduct electrical energy.

The fiber optic pressure sensor arrangement 12 also includes an electro-explosive actuator 80, such as an explosively-activated piston actuator, electrically connected to the photosensitive device 64. The electro-explosive actuator 80 is operable in response to the electrical energy or current conducted by the photosensitive device 64 to produce a mechanical force of a magnitude sufficient to actuate or push the lever 44 to release the fuze rotor 42 and permit it to move the unarmed to armed condition.

Finally, the fiber optic pressure sensor arrangement 10 includes a light routing element 82 that defines a light transmission path from the light-emitting device 62 to the photosensitive device 64 via the pressure sensor 56. The light routing element 82 preferably is a pair of first and second fiber optic cables 84, 86. The first fiber optic cable 84 defines a first branch of the light transmission path from the light-emitting device 62 to the light reflective surface 70A of the pressure sensor piston 70. The second fiber optic cable 86 defines a second branch of the light transmission path from the light reflective surface 70A of the pressure sensor piston 70 to the photosensitive device 64.

The light routing element 82 is responsive to the displacement of the pressure sensor piston 70 to the first position of FIG. 3 by transmitting insufficient light energy from the light-emitting device 62 to the photosensitive device 64 via the reflective surface 70A of the piston 70 at the first position to cause the photosensitive device 64 to conduct electrical energy to the electro-explosive actuator 80. On the other hand, the light routing element 82 is responsive to the displacement of the pressure sensor piston 70 to the second position by transmitting sufficient light energy from the light-emitting device 62 to the photosensitive device 64 via the reflective surface 70A of the piston 70 at the second position to cause the photosensitive device 64 to conduct electrical energy to the electro-explosive actuator 80.

Thus, it can be understood that the electro-explosive actuator 80 is incapable of actuating the fuze rotor 42 from the unarmed condition to armed condition without both the first and second environmental conditions of the munition 10 occurring first, namely setback of the munition projectile 16 and ignition of the propellant 52 of the munition 10. The fuze 38 of the munition 10 will arm only when both setback and the pressure from burning propellant 52 are present. If a condition were to occur where there was setback but no pressure (such as when the munition was dropped from a great height and landed on the base plate 20), then the fuze 38 would not arm because the reflective surface 70A of the piston 70 was too far away from the fiber optic cables 84, 86 to reflect enough light to cause the photosensitive device 64 to conduct. In other words, the light signal is attenuated by the distance between the reflective surface 70A and the fiber optic cables 84, 86. Conversely, if a condition were to occur where there was pressure but no setback (such as in the case of a fire), then the fuze 38 would not arm because the setback-activated battery 60 would not power up and consequently no voltage would exist to power the photosensitive device 64 nor the light-emitting device 62.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

Having thus described the invention, what is claimed is:

1. An arrangement for use in safing and arming a fuze in a munition, said arrangement comprising:

(a) first means responsive to the occurrence of a first environmental condition of the munition for producing displacement of said first means from a first position to a second position;

(b) second means responsive to the occurrence of a second environmental condition of the munition for generating an electrical voltage and emitting light energy, the second environmental condition being different from the first environmental condition;

(c) third means responsive to the generation of the voltage and to receipt of light energy for conducting electrical energy;

(d) fourth means responsive to conducting of the electrical energy for actuating a rotor of the munition fuze from an unarmed condition to an armed condition; and (e) fifth means for defining a light transmission path from said second means to said third means via said first means, said fifth means being responsive to the displacement of said first means to said first position for transmitting insufficient light energy from said second means to said third means to cause said third means to conduct electrical energy to said fourth means and being responsive to the displacement of said first means to said second position for transmitting sufficient light energy from said second means to said third means to cause said third means to conduct electrical energy to said fourth means, said fourth means thereby being incapable of actuating the fuze rotor from the unarmed condition to armed condition without both the first and second environmental conditions of the munition occurring first.

2. The arrangement of claim 1 wherein said first means responsive to the first environmental condition is a pressure sensor responsive to pressure generated by the igniting of a propellant of the munition.

3. The arrangement of claim 2 wherein said pressure sensor includes:

a housing;

a piston reciprocal between said first and second displaced positions in said housing and having a light reflective surface; and a blocking element for maintaining said piston at said first position but being fracturable by imposition of a force of a predetermined magnitude thereon.

4. The arrangement of claim 3 wherein said piston is responsive to contact by expanding high pressure gases generated from igniting of the propellant in the munition for producing a force of a magnitude greater than the force of the predetermined magnitude to fracture of said blocking element and thereby permitting movement of said piston from said first position to said second position.

5. The arrangement of claim 1 wherein said second means responsive to the second environmental condition includes:

a power supply responsive to a force of a predetermined magnitude imposed by a setback of a projectile of the munition to produce the electrical voltage; and a light-emitting device electrically connected to said power supply and being responsive to the electrical voltage to emit light energy.

6. The arrangement of claim 5 wherein said fifth means is a light routing element for transmitting light energy along said light transmission path from said second means to said third means via said first means.

7. The arrangement of claim 6 wherein said light routing element is a pair of first and second fiber optic cables, said first fiber optic cable defining a first branch of said light transmission path from said light-emitting device of the second means to said first means, said second fiber optic cable defining a second branch of said light transmission path from said first means to said said third means

8. The arrangement of claim 1 wherein said third means responsive to the generation of the voltage and receipt of light energy is a photosensitive device electrically connected to and powered by said second means, said photosensitive device being operable to switch "on" to a conducting mode when receiving light energy, said photosensitive device being operable to switch "off" to a non-conducting mode in the absence of light energy.

9. The arrangement of claim 8 wherein said fourth means responsive to the conducting of the electrical energy is an electro-explosive actuator, said electro-explosive actuator in response to said electrical energy being operable to produce a mechanical force of a magnitude sufficient to actuate the rotor of the munition fuze from the unarmed condition to the armed condition.

10. The arrangement of claim 8 wherein said fifth means is a light routing element for transmitting light energy along said light transmission path from said second means to said third means via said first means.

11. The arrangement of claim 10 wherein said light routing element is a pair of first and second fiber optic cables, said first fiber optic cable defining a first branch of said light transmission path from said second means to said first means, said second fiber optic cable defining a second branch of said light transmission path from said first means to said photosensitive device of said third means.

12. The arrangement of claim 1 wherein said fifth means is a light routing element for transmitting light energy along said light transmission path from said second means to said third means via said first means.

13. The arrangement of claim 12 wherein said light routing element is a pair of first and second fiber optic cables, said first fiber optic cable defining a first branch of said light transmission path from said second means to said first means, said second fiber optic cable defining a second branch of said light transmission path from said first means to said third means.

14. An arrangement for use in safing and arming a fuze in a munition, said arrangement comprising:

(a) means responsive to contact by a pressure generated by ignition of a propellant of the munition for producing displacement of said pressure-responsive means from a first position to a second position;

(b) a power supply responsive to a force of a predetermined magnitude imposed by a setback of a projectile of the munition to generate an electrical voltage;

(c) a light-emitting device electrically connected to said power supply and being responsive to generation of the voltage to emit light energy;

(d) a photosensitive device electrically connected to and powered by the voltage generated by said power supply and being operable to switch "on" to a conducting mode when receiving light energy and to switch "off" to a non-conducting mode in the absence of light energy;

(e) an actuator electrically connected to said photosensitive device and in response to the conducting of the electrical energy being operable to produce a force of a magnitude sufficient to actuate a rotor of the munition fuze from an unarmed condition to an armed condition; and (f) a light routing element defining a light transmission path from said light-emitting device to said photosensitive device via said pressure-responsive means, said light routing element being responsive to the displacement of said pressure-responsive means to said first position for transmitting insufficient light energy from said light-emitting device to said photosensitive device to cause said photosensitive device to conduct electrical energy to said actuator, said light routing element being responsive to the displacement of said pressure-responsive means to said second position for transmitting sufficient light energy from said light-emitting device to said photosensitive device to cause said photosensitive device to conduct electrical energy to said actuator, said actuator thereby being incapable of actuating the rotor fuze from the unarmed condition to armed condition without both the setback of said power supply and the ignition of the propellant occurring first.

15. The arrangement of claim 14 wherein said light routing element is a pair of first and second fiber optic cables, said first fiber optic cable defining a first branch of said light transmission path from said light-emitting device to said pressure-responsive means, said second fiber optic cable defining a second branch of said light transmission path from said pressure-responsive means to said photosensitive device.

16. The arrangement of claim 14 wherein said pressure-responsive means is a pressure sensor.

17. The arrangement of claim 16 wherein said pressure sensor includes:

a housing;

a piston reciprocal between said first and second displaced positions in said housing and having a light reflective surface; and a blocking element for maintaining said piston at said first position but being fracturable by imposition of a force of a predetermined magnitude thereon.

18. The arrangement of claim 17 wherein said piston is responsive to contact by expanding high pressure gases generated from igniting of the propellant in the munition for producing a force of a magnitude greater than the force of the predetermined magnitude to fracture of said blocking element and thereby permitting movement of said piston from said first position to said second position.

* * * * *